United States Patent [19]

Ford, Jr.

[11] 3,987,633

[45] Oct. 26, 1976

[54] PRESSURIZED GAS OPERATED ENGINE

[76] Inventor: Sanders Ford, Jr., 1309 S. 58th St., Richmond, Calif. 94804

[22] Filed: Apr. 19, 1974

[21] Appl. No.: 462,217

[52] U.S. Cl. ..... 60/671

[51] Int. Cl.[2] ..... F01K 25/10

[58] Field of Search ..... 123/1; 60/651, 671; 180/66, 67; 137/625.11, 625.15; 251/209

[56] References Cited

UNITED STATES PATENTS

| | | | |
|---|---|---|---|
| 1,744,288 | 1/1930 | Vorel | 60/513 |
| 1,960,515 | 5/1934 | Shield | 137/625.11 |
| 2,884,908 | 5/1959 | Campbell | 123/1 X |
| 2,972,357 | 2/1961 | Ford et al. | 137/625.11 |
| 3,096,788 | 7/1963 | Talbot et al. | 137/625.11 |
| 3,563,032 | 2/1971 | La Pointe | 60/412 |
| 3,589,126 | 6/1971 | Zotto | 60/671 |
| 3,885,387 | 5/1975 | Simington | 123/DIG. 7 |

*Primary Examiner*—Allen M. Ostrager
*Attorney, Agent, or Firm*—William W. Haefliger

[57] ABSTRACT

High pressure gas distribution apparatus is connected with an engine cylinder to drive a piston therein, and comprises a. a body containing a high pressure gas inlet and an outlet port, b. a rotor rotatable in the body to control metering of gas from said inlet to said outlet port c. the rotor having a connection to be driven by the engine in timed relation to motion of the piston.

1 Claim, 12 Drawing Figures

59
58
68
18
68
44b
42
40
70
58
53
59
44
51
20
47
44a
46
41
54

11
69
41
46
43
69
11

41
69
69
43

42
47
44a
9
9
70
45
71

42
44a
47
7
7
70
8
8
51
55
44b
50
44
6
6

50
55
42
44b 54
47
44a
71
70
45
55
55
42
51
44
44b
50

56
55
51
55a
50
42
44

SHUT OFF VALVE (KEY CONTROLLED)
CONTROL VALVE
IDLE VALVE
GAS DISTRIBUTOR
POWER
PRESSURE CONTROLLED SWITCH
HEAT EXCHANGER
M
10
11
12
13
14
15
16
17
18
19
20
21
22
23
24
25
26
27
28
29
30
31
31a
32
34
35
65

PRESSURIZED GAS OPERATED ENGINE

BACKGROUND OF THE INVENTION

This invention relates generally to engines, and more particularly concerns a non-combustible gas pressure driven engine of unusually advantageous construction and operation.

There is a great need for development of engines characterized as non-polluting, and which are simple, efficient, and no more expensive to operate than present day gasoline or Diesel engines. There is also a great need for means to convert existing internal combustion engines to non-polluting operation, to save the vast cost of replacement of such engines; however it has been thought that great problems stand in the way of such conversion.

SUMMARY OF THE INVENTION

It is a major object of the invention to meet the above needs and to overcome the conversion problems, in a simple and effective manner. Basically, the invention enables operation of reciprocating piston engines through supply of high pressure non-combustible gas to the engine cylinders in timed relation to engine speed, and in a novel manner, as will be seen. Regarding system aspects, the invention has unusally advantageous application to an internal combustion engine having spark plug openings, valves, pistons, and a spark distributor rotor driven by the engine, the system including:

a. a source of relatively high pressure gas, b. gas pressure lines connected with the cylinders via said spark plug openings, and c. distribution means operatively connected with said rotor to be driven thereby for controlling distribution of said high pressure gas from said source via said lines to said cylinders for urging the pistons in power stroke directions in the cylinders.

As will be seen, the source may comprise liquified gas such as nitrogen which, when exhausted, returns to the atmosphere from which it was derived, without pollution effect. Suitable control valving may control the flow of such gas from a container to the distribution means as described, to control engine torgue and speed; and check valves in the lines near the cylinders may pass the gas flow to the cylinders only when sufficient pressure is developed in the lines, as controlled by the distribution means. The latter may advantageously include a body containing a high pressure gas inlet and an outlet part; a rotor rotatable in the body to control metering of gas from the inlet to the outlet, and a connection on the rotor to be driven by the engine in timed relation to piston reciprocation, as will be seen.

These and other objects and advantages of the invention, as well as the details of an illustrative embodiment, will be more fully understood from the following description and drawings, in which:

DRAWING DESCRIPTION

DETAILED DESCRIPTION

Figure 1:
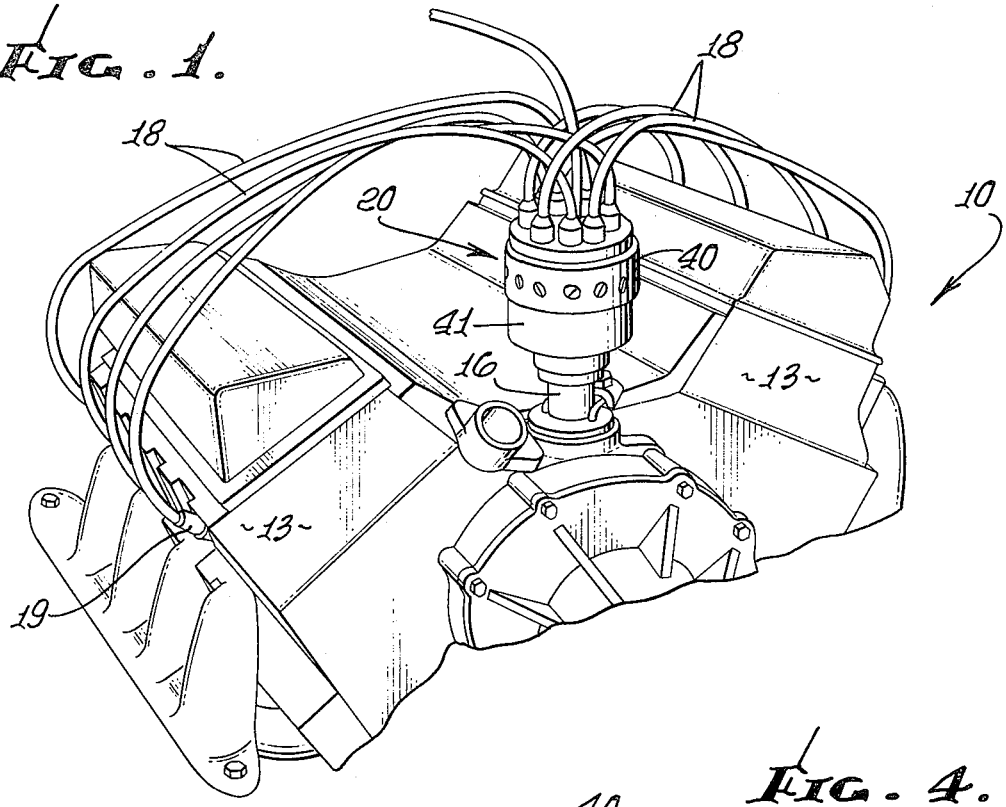
FIG. 1 is a perspective view of an automobile engine incorporating the invention.
Figure 12:
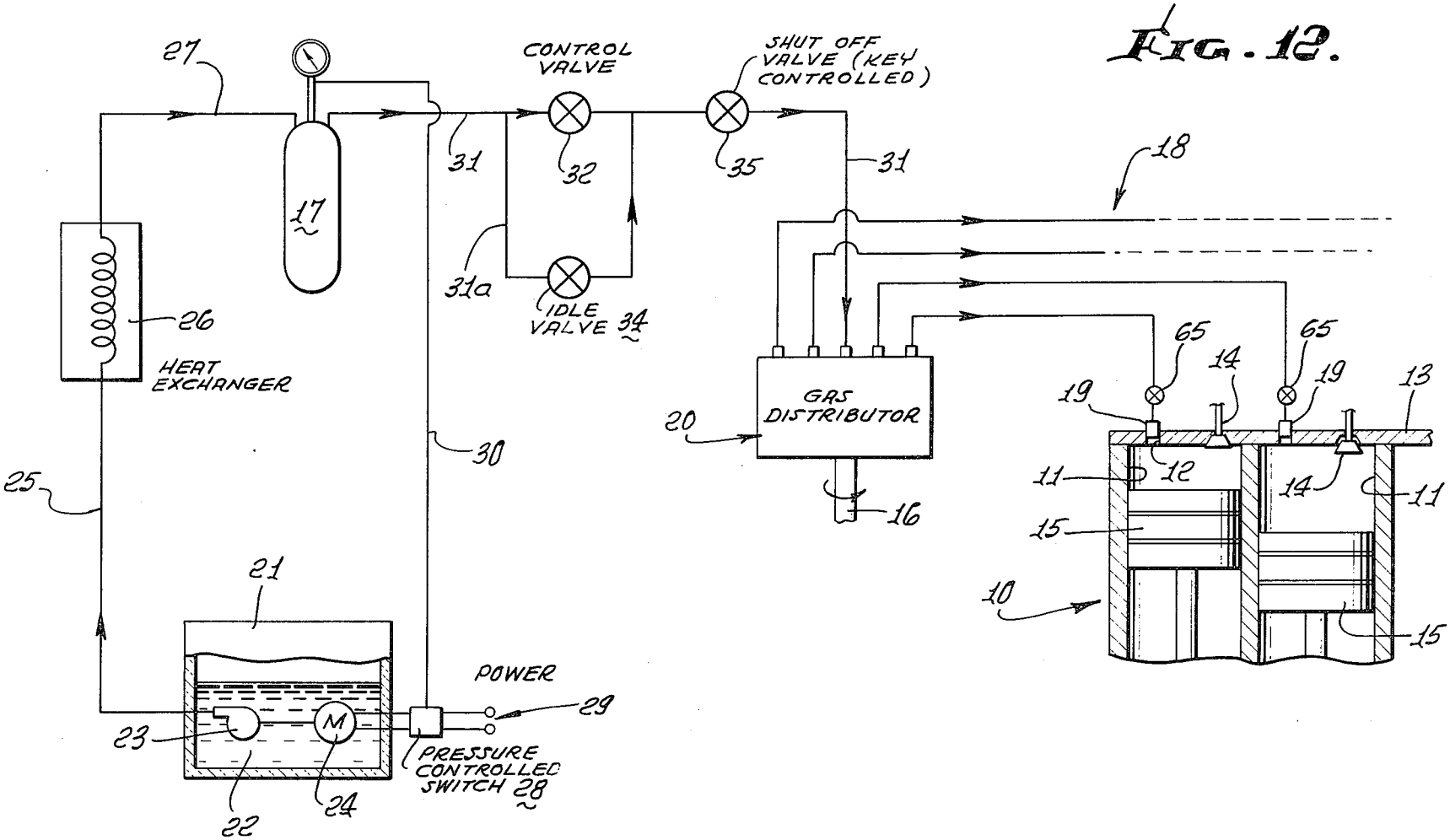
FIG. 12 is a diagramatic showing of a system incorporating the invention.

Referring to FIGS. 1 and 12, the internal combustion engine 10 to be converted to liquid nitrogen or other gas operation has multiple cylinders 11 with associated spark plug openings 12 in a head 13. The engine also includes exhaust valves 14, pistons 15, and a spark distributor rotor 16 driven by the engine.

In accordance with the invention, a source of relatively high pressure gas such as nitrogen is provided, as for example may include bottle 17; also, multiple gas pressure lines are connected with the cylinders 11 via the spark plug openings 12, the plugs having been removed. Typical gas lines 18 are shown, with end fittings 19 threaded into the spark plug openings.

Distribution means 20 is operatively connected with the rotor to be driven thereby for controlling distribution of the high pressure gas from the source in the lines 18 to the cylinders 11 for urging the pistons in power stroke directions in the cylinders. In this regard, advantage is taken of the timing of the rotor 16 (which previously controlled transmission of ignition sparks to the spark plugs), for controlling pressure application to the pistons just after they have passed top dead center in their reciprocation. Typically, the gas pressure supplied to the pistons will exceed 2,000 psi, and such supply will be momentary only, i.e. the means 20 will gate the flow of high pressure gas to a cylinder during only a few degrees of rotor rotation, such pressure will drive the piston downwardly in the cylinder, as the limited quantity of admitted gas expands to a lower pressure in the cylinder, and the exhaust valve 14 will open as controlled by the cam shaft driven by the engine to exhaust the spent gas on the piston upstroke.

Referring to FIG. 12, the gas source may also be considered to include a reservoir 21 for liquified gas such as nitrogen 22, the reservoir being appropriately thermally insulated. A pump 23 in the container is intermittently driven by a motor 24 to pump the liquid 22 via line 25 to a heat exchanger 26 for evaporation and flow via line 27 to the container 17. A control means, such as a pressure controlled switch 28 is operatively connected with the motor (as via the power input lines 29), and also with the container 17 (as via pressure line 30), to effect motor and pump operation in response to predetermined gas pressure reduction in the container 17, for resupplying the container.

A supply duct 31 communicates between the container 17 and the distribution means 20, and a control valve 32 is connected in that duct to control the rate of flow of high pressure gas to the means 20, thereby to control energization (torque development) of the engine. Valve 32 may be connected with the accelerator pedal in an automobile, for example. A by-pass line **31*a* extends around valve 32, and an idle valve 34 is connected in line 31*a*. Valve 34 is always open sufficiently to effect idle or slow speed operation of the engine. An ON-OFF valve 35 in line 31** may be ignition-key operated to turn ON when engine operation is desired.

Referring now to FIGS. 2–11, the distribution means 20 may advantageously include body sections 40 and 41, and a rotor assembly 42. Section 41 contains a counterbore 43 to receive bearing race 70 associated with the assembly 42. The latter also includes a rotor 44 carrying an inner race 45, there being bearing balls 71 between the two races. Rotor 44 extends at **44*a* within bore 46 in section 41 to couple to the drive rotor 16, as via a pin 47**.

Figure 4:
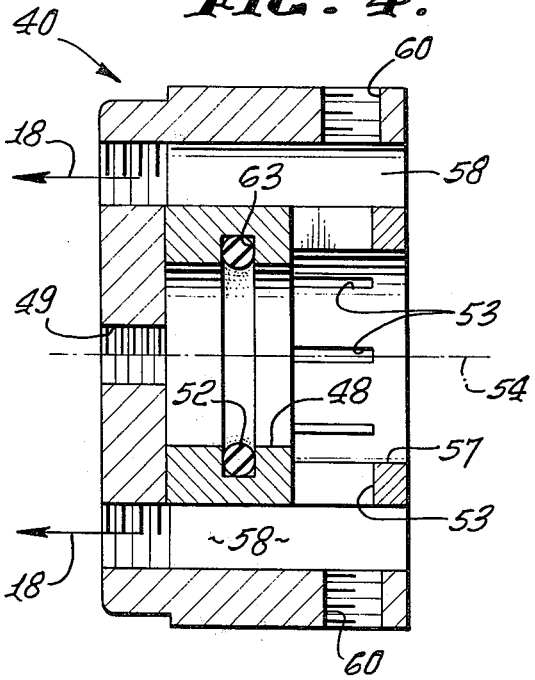
FIG. 4 is a section on lines 4—4 of FIG. 3.
Figure 3:
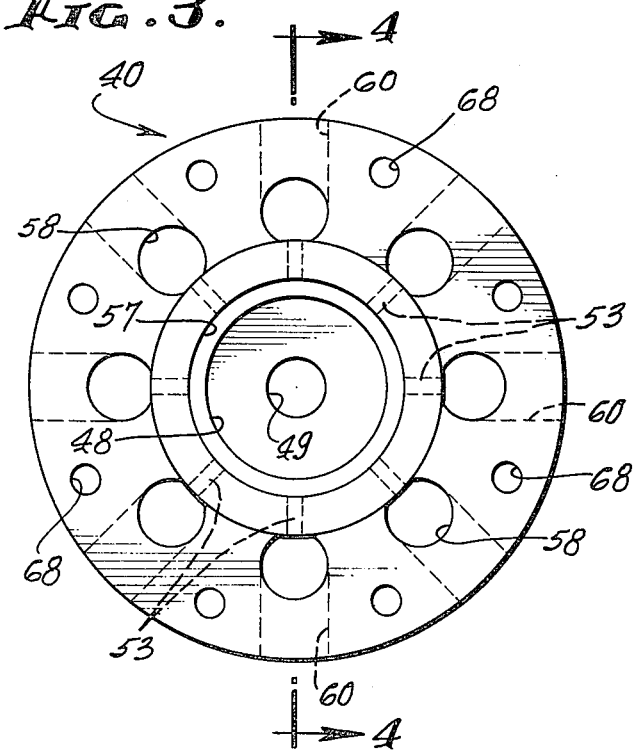
FIG. 3 is an end view of a valve body section shown in FIG. 2.
Figure 2:
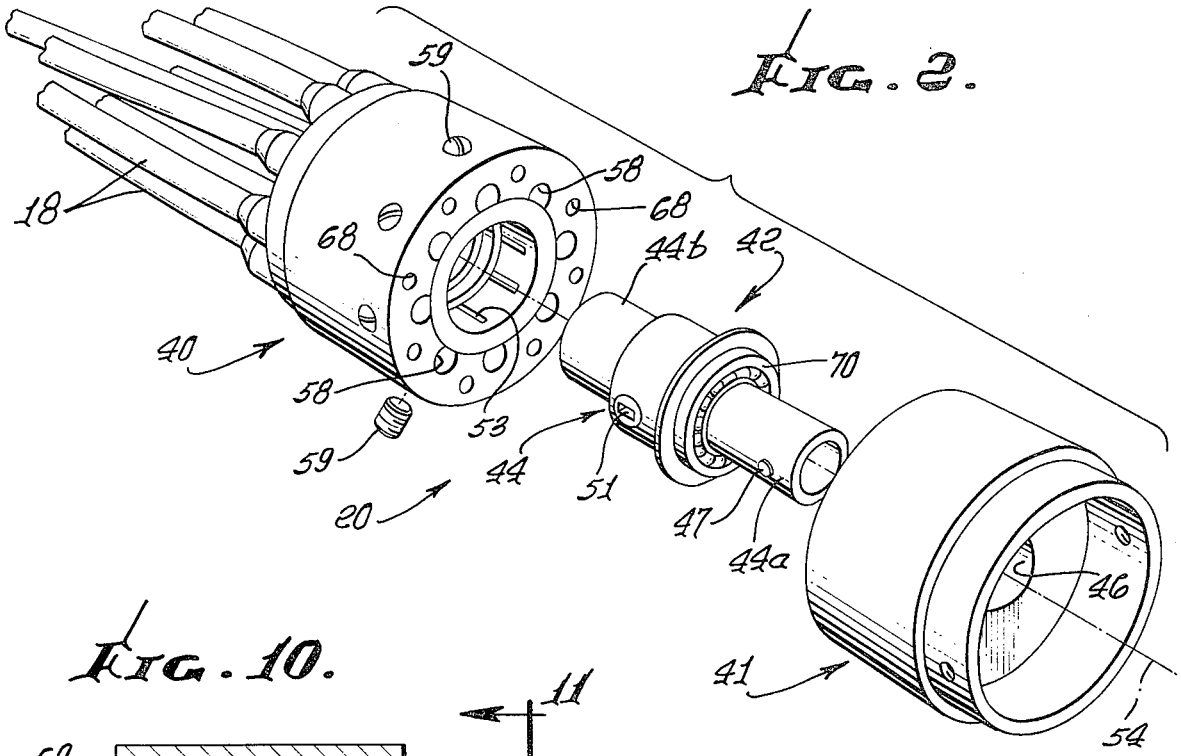
FIG. 2 is an exploded view of a valving apparatus.
Figure 10:
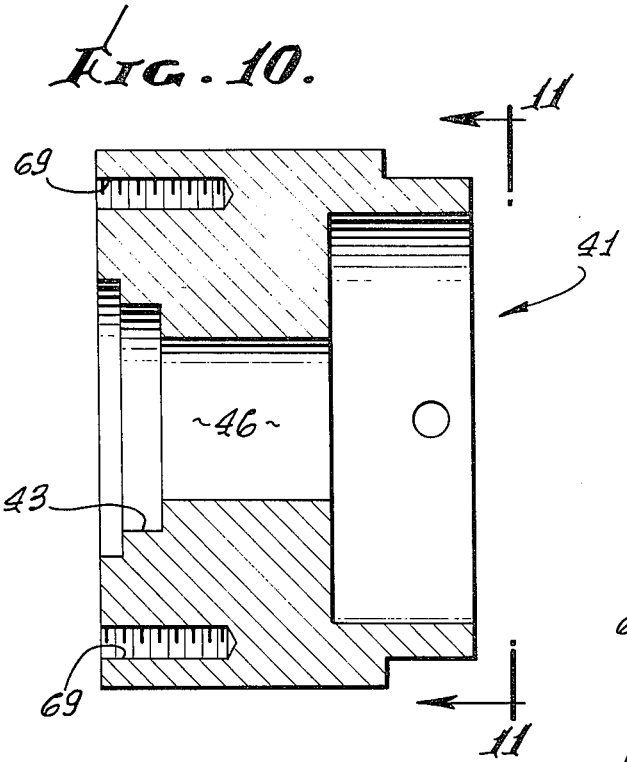
FIG. 10 is a section through another body section seen in FIG. 2.
Figure 11:
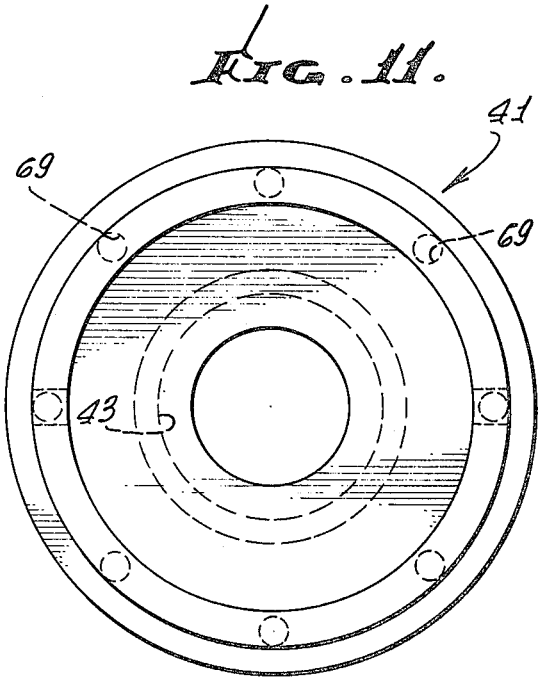
FIG. 11 is an end view on lines 11—11 of FIG. 10.
Figures 5, 6, 7, 8, 9:
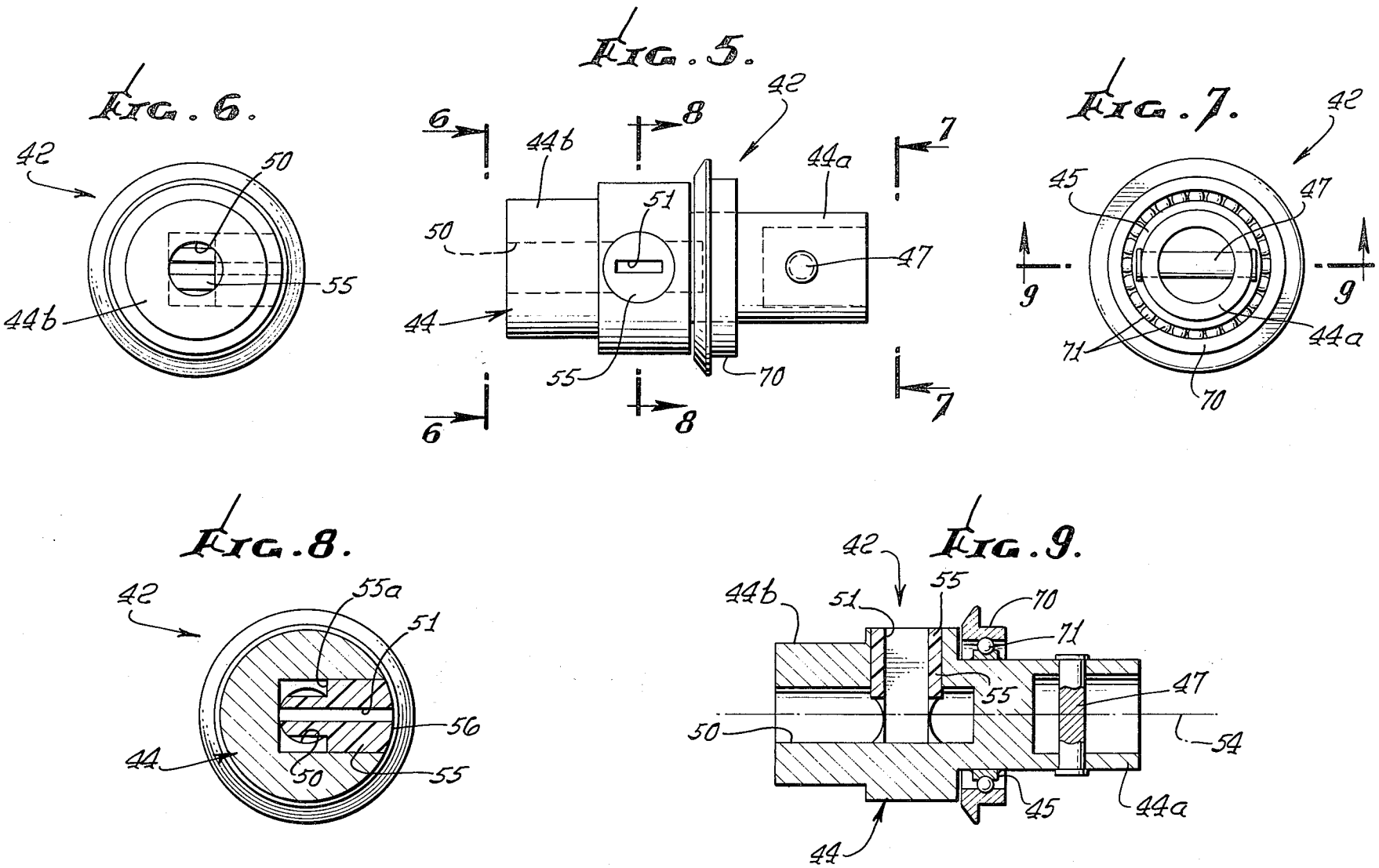
FIG. 5 is a side elevation of a rotor shown in FIG. 2.
FIG. 6 is an end view on lines 6–6 of FIG. 5.
FIG. 7 is an end view on lines 7—7 of FIG. 5.
FIG. 8 is a section on lines 8—8 of FIG. 5.
FIG. 9 is a section on lines 9—9 of FIG. 7.

Rotor 44 includes tubular extent **44*b* received in a bore 48 in body section 40 whereby high pressure gas entering the section 40 via inlet 49 may pass into the bore 50 of the rotor tubular extent for distribution via rotating outlet 51. Note the O-ring seal 52 retained in groove 63 in body section 40 to seal off against the outer surface of the rotor extent 44*b* and block escape of gas. As outlet 51 successively passes in registration with the circumferentially spaced outlet ports 53 in the body section 40, high pressure gas is metered to those ports, for time intervals which decrease as the engine speed increases. Slot-like ports 53 and outlet 51 have similar narrow rectangular cross-sections, in cylindrical planes about the axis 54, for accurate metering. Outlet 51 may be formed by a TEFLON or other plastic plunger-insert 55, as seen in FIGS. 8 and 9, that insert having a curved outer surface at 56 to seal against the bore 57 during rotation. Gas pressure is exerted at inner surface 55*a* of the insert to urge it outwardly to seal, as described. Outlets 53 communicate with pressure lines 18 via transfer ports 58, as shown in FIG. 4. Clean-out or inspection plugs 59, as seen in FIG. 2, are removably received in drilled and threaded side ports 60, seen in FIG. 4**.

Referring again to FIG. 12, the lines 18 contain check valves 65 near the engine which operate to pass the flow of high pressure gas to the cylinders only when the pressure in the lines 18 upstream of the valves exceeds predetermined levels as controlled by the distribution means. Accordingly, gas is supplied to a piston only when there is sufficient gas pressure in associated line 18 to drive the piston, as required.

In FIGS. 2–11, bolts are receivable in body section openings 68 and 69, to hold the assembly together.

Other gases, such as air, may be used to operate the engine. Also, the engine may be of rotary type, such as a Wankel engine.

I claim:

1. In an engine having chamber structure including a head and reciprocating piston means movable in said chamber structure, said structure having associated inlet porting and valving in the head, and a rotor driven by the engine, the combination comprising:

a. a source of relatively high pressure gas b. gas pressure ducting connected with said chamber structure via said porting, and c. distribution means operatively connected with said rotor to be driven thereby for controlling distribution of said high pressure gas from said ducting to said porting for urging the piston means in a power stroke direction in the chamber structure, d. said source including a resevoir for storing a supply of said gas in its liquified state, a heat exchanger for transforming said liquified gas into a high pressure gas, a container for receiving and storing said high pressure gas subsequent to the heating of the liquified gas in said heat exchanger, duct means connecting the reservoir, the heat exchanger and container for serial flow of fluid therethrough e. said source means further including a pump means for delivering the liquified gas from the reservoir to the heat exchanger and the to the container, said pump means being energized by a pressure responsive means, said pressure responsive means being responsive to the pressure in said container, whereby said pump is energized upon a predetermined drop in gas pressure within said container to deliver liquified gas from the reservoir, to the heat exchanger and then to said container, f. a duct communication between the container and said distribution controlling means, and a first control valve connected in series with said duct to variably control the flow of said high pressure gas to said distribution means, a second nonvariable valve in parallel flow relationship to said first control valve, said second valve providing a constant flow rate therethrough.

g. said distribution means including a housing having a single inlet, and multiple outlets communicating with said ducting in the form of multiple ducts, a gas distributor rotor axially rotatable in the housing by the engine driven rotor, the gas distributor rotor controlling flow of high pressure gas from said single inlet to said multiple outlets, said outlets formed as slots which are spaced about the rotor and are relatively narrow in the rotary direction of rotor rotation, said outlet slots formed in said housing, the distribution rotor having a single rotating gas distributing outlet formed as a slot which has successive registration with said outlet slots as the rotor rotates, said outlet slots elongated in a direction generally parallel to the rotor axis, said narrow and elongated outlet slots being generally rectangular and h. check valve means in said ducting to pass the flow of said high pressure gas from said distribution means to said chamber structure only when the gas pressure in said ducting exceeds predetermined level as controlled by operation of said distribution means.

* * * * *